US008994764B2

(12) United States Patent
Watanabe

(10) Patent No.: US 8,994,764 B2
(45) Date of Patent: Mar. 31, 2015

(54) IMAGE DISPLAY APPARATUS AND IMAGE DISPLAY METHOD

(75) Inventor: Ryoki Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 311 days.

(21) Appl. No.: 13/052,564

(22) Filed: Mar. 21, 2011

(65) Prior Publication Data

US 2011/0234650 A1 Sep. 29, 2011

(30) Foreign Application Priority Data

Mar. 25, 2010 (JP) ..... 2010-070283

(51) Int. Cl.
*G09G 3/00* (2006.01)
*G09G 5/399* (2006.01)

(52) U.S. Cl.
CPC ..... *G09G 3/003* (2013.01); *G09G 3/005* (2013.01); *G09G 5/399* (2013.01); *G09G 2340/0407* (2013.01)
USPC ..... 345/698; 345/690; 353/30; 348/E9.025; 348/E9.027; 349/5

(58) Field of Classification Search
CPC ..... G09G 3/007
USPC ..... 345/690, 698, 56, 696; 353/30; 348/751, E09.025, E9.025, E9.027; 352/41, 104, 109, 138, 166, 203; 349/5
See application file for complete search history.

(56) References Cited

U.S. PATENT DOCUMENTS

| | | | | |
|---|---|---|---|---|
| 6,577,341 | B1 * | 6/2003 | Yamada et al. | 348/272 |
| 2004/0114040 | A1 * | 6/2004 | Bellwood et al. | 348/173 |
| 2005/0111072 | A1 * | 5/2005 | Miyagaki et al. | 359/279 |
| 2006/0007057 | A1 * | 1/2006 | Choi et al. | 345/9 |
| 2007/0140332 | A1 * | 6/2007 | Sugimura | 375/240.01 |
| 2008/0158513 | A1 * | 7/2008 | Bartlett et al. | 353/30 |
| 2009/0147031 | A1 * | 6/2009 | Miyazawa | 345/690 |
| 2009/0303170 | A1 * | 12/2009 | Chung et al. | 345/102 |
| 2011/0090465 | A1 | 4/2011 | Watanabe | |

FOREIGN PATENT DOCUMENTS

| | | |
|---|---|---|
| JP | 11-298829 | 10/1999 |
| JP | 2005-091519 | 4/2005 |
| JP | 2009-053516 | 3/2009 |
| JP | 2009071444 | 4/2009 |

* cited by examiner

*Primary Examiner* — Lun-Yi Liao
*Assistant Examiner* — Saiful A Siddiqui
(74) *Attorney, Agent, or Firm* — Workman Nydegger

(57) ABSTRACT

An image display apparatus includes: a light source that outputs light; a light modulation device that has plural pixels arranged in a matrix and modulates the light from the light source; a projection system that projects the light modulated by the light modulation device onto a projection surface; a pixel image shift unit that can shift positions of images of the pixels of the light modulation device projected on the projection surface; and a control unit that controls the light modulation device and the pixel image shift unit, wherein the control unit can switch whether the pixel image shift unit temporally shifts the positions of the images of the pixels or not.

10 Claims, 7 Drawing Sheets

IMAGE DISPLAY APPARATUS AND IMAGE DISPLAY METHOD

This application claims priority to Japanese Patent Application No. 2010-070283, filed on Mar. 25, 2010, the entirety of which is hereby incorporated by reference.

BACKGROUND

1. Technical Field

The present invention relates to an image display apparatus and an image display method.

2. Related Art

In a projection-type image display apparatus of such as a projector, in the case where the image display apparatus includes light modulation devices such as liquid crystal light valves, the resolution of an image projected on a screen is typically equal to the resolution of the light modulation devices (the number of horizontal pixels, the number of vertical pixels). In the following explanation, "resolution of image projected on screen" will be referred to as "display resolution". Here, as a method of improving the display resolution without changing the resolution of the light modulation devices, there is a method of increasing the number of light modulation devices and performing projection while shifting the positions of the images of the respective pixels formed by the respective light modulation devices on the screen. However, according to the method, it is necessary to increase the number of light modulation devices, and there is a problem that significant increase in costs is caused.

As a method of solving the problem, a method of shifting the positions of the images of the respective pixels not spatially but along the temporal axis has been proposed (for example, see Patent Documents 1, 2 (JP-A-11-298829, JP-A-2005-91519)). According to the method, it is unnecessary to increase the number of light modulation devices. In Patent Document 1, as a specific example, a configuration in which a parallel plate is inserted between the light modulation devices and a projection lens at a tilt relative to the normal line of the optical axis, the optical axis is shifted with respect to each field by changing the tilt angle of the parallel plate, and the positions of the pixels are temporally shifted has been proposed. As another specific example, a configuration in which a rotating plate having two regions different in refractive index or amount of refraction is obliquely inserted between the light modulation devices and the projection lens, the optical axis is shifted by rotating the rotating plate, and the positions of the images of the pixels are temporally shifted has been proposed.

Note that, in the following explanation, temporal (temporal axis) shift of the positions of the images of the respective pixels on a projection surface may be referred to as "temporal axis pixel shift" for convenience.

However, as in Patent Documents 1, 2, the image display apparatus in related art of employing the temporal axis pixel shift technology constantly performs display while shifting the positions of the images of the respective pixels along the temporal axis regardless of contents of externally input images. The temporal axis pixel shift technology is to improve the display resolution by displaying images for one frame in the shifted positions using two frames for pixel shift, for example. In other words, the temporal axis pixel shift technology is a technology of improving the spatial resolution at the expense of the temporal resolution. Therefore, the technology is suitable for still images having no temporal frequency components, but not suitable for moving images having temporal frequency components. For example, deterioration of image quality such that images moving at a high speed blur may be caused.

Further, in the apparatus of Patent Document 2, as means for reducing blur of the images, a technology of inserting a frame for black representation between plural frames for image display has been disclosed. However, in the case of using the technology, there is a problem that the brightness of display is deteriorated by the insertion of the black representation.

SUMMARY

An advantage of some aspects of the invention is to provide an image display apparatus and an image display method that can improve display resolution of still images while preventing image quality deterioration of moving images such that the moving images blur or become darker.

An image display apparatus according to an aspect of the invention includes a light source that outputs light, a light modulation device that has plural pixels arranged in a matrix and modulates the light from the light source, a projection system that projects the light modulated by the light modulation device onto a projection surface, a pixel image shift unit that can shift positions of images of the pixels of the light modulation device projected on the projection surface, and a control unit that controls the light modulation device and the pixel image shift unit, wherein the control unit can switch whether the pixel image shift unit temporally shifts the positions of the images of the pixels or not.

Further, it is desirable that the control unit controls the pixel image shift unit to temporally shift the positions of the images of the pixels on the projection surface if images to be displayed are still images and not to temporally shift the positions of the images of the pixels on the projection surface if the images to be displayed are moving images.

The image display apparatus according to the aspect of the invention switches use or nonuse of the temporal axis pixel shift technology according to whether the images to be displayed are still images or moving images. That is, according to the image display apparatus of the aspect of the invention, the control unit can switch whether the pixel image shift unit temporally shifts the positions of the images of the pixels or not. More specifically, the control unit controls the pixel image shift unit to temporally shift the positions of the images of the pixels on the projection surface if the images to be displayed are still images, and display resolution of the still images may be improved. On the other hand, the unit controls the pixel image shift unit not to temporally shift the positions of the images of the pixels on the projection surface if the images to be displayed are moving images, and image deterioration of blur of the moving images or the like may be suppressed and smooth moving images may be represented. Further, the smooth moving images may be represented without insertion of frames of black representation, and thus, the display does not become darker.

In the image display apparatus according to the aspect of the invention, a configuration in which the control unit controls the pixel image shift unit to temporally shift the positions of the images of the pixels on the projection surface constantly unless images to be displayed are determined to be moving images may be employed.

According to the configuration, the temporal axis pixel shift function is basically performed and the temporal axis pixel shift function is stopped only when the control unit determines that the images are moving images, and therefore, the temporal axis pixel shift function may be exerted at the maximum and the display resolution may sufficiently be improved.

In the image display apparatus according to the aspect of the invention, the control unit may include an image determination part that compares respective image data input in plural frames and determines whether images to be displayed are still images or moving images, and the image determination part may output a control signal to the pixel image shift unit based on a determination result of itself.

According to the configuration, the image determination part may determine the use or nonuse of the temporal axis pixel shift function using normal image data. It is not necessary to prepare special image data.

Alternatively, in the image display apparatus according to the aspect of the invention, the control unit may include an image determination part that acquires still image/moving image information previously contained in input image data, and determines whether images to be displayed are still images or moving images from the still image/moving image information, and the image determination part may output a control signal to the pixel image shift unit based on a determination result of itself.

According to the configuration, it is necessary to prepare image data previously containing the still image/moving image information, however, means for comparing image data of plural frames and determining whether the images are still images or moving images (for example, a frame memory and a computation part) are not necessary, and the load on the apparatus may be reduced and the configuration of the control unit may be simplified.

In the image display apparatus according to the aspect of the invention, the control unit controls the pixel image shift unit to temporally shift the positions of the images of the pixels on the projection surface if resolution of images to be displayed is higher than resolution of the light modulation device and not to temporally shift the positions of the images of the pixels on the projection surface if the resolution of the images to be displayed is equal to or lower than the resolution of the light modulation device.

According to the configuration, the resolution of the images to be displayed and the resolution of the light modulation device may be compared, and the temporal axis pixel shift function may be determined to be effective and the function may be performed only if the resolution of the images to be displayed is higher than the resolution of the light modulation device.

An image display method according to another aspect of the invention is an image display method using an image display apparatus including a light source that outputs light, a light modulation device that has plural pixels arranged in a matrix and modulates the light from the light source, a projection system that projects the light modulated by the light modulation device onto a projection surface, and a pixel image shift unit that shifts positions of images of the pixels of the light modulation device projected on the projection surface, and the method includes controlling the pixel image shift unit to temporally shift the positions of the images of the pixels on the projection surface if images to be displayed are still images and not to temporally shift the positions of the images of the pixels on the projection surface if the images to be displayed are moving images.

According to the image display method of the aspect of the invention, the positions of the images of the pixels on the projection surface are temporally shifted if the images to be displayed are still images, and display resolution of the still images may be improved. On the other hand, the positions of the images of the pixels on the projection surface are not temporally shifted if the images to be displayed are moving images, and image deterioration of blur of the moving images or the like may be suppressed and smooth moving images may be represented. Further, it is not necessary to insert frame of black representation, and thus, the display does not become darker.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, the first embodiment of the invention will be explained using FIGS. 1 to 6.

An image display apparatus of the embodiment is a configuration example of the so-called 3LCD projector having three liquid crystal light valves.

Figure 1:
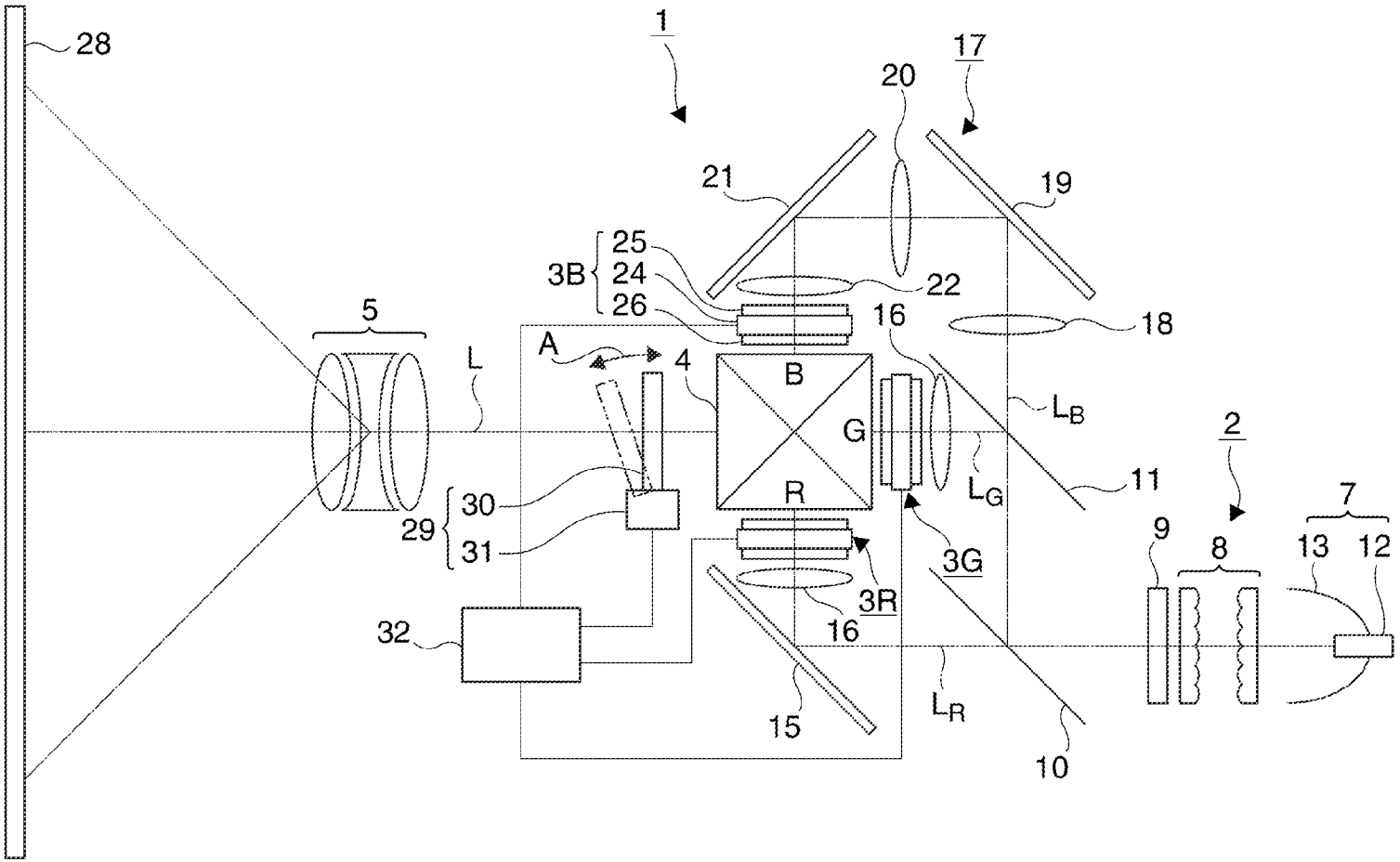
FIG. 1 is a schematic configuration diagram of a projector of a first embodiment of the invention.
Figure 2:
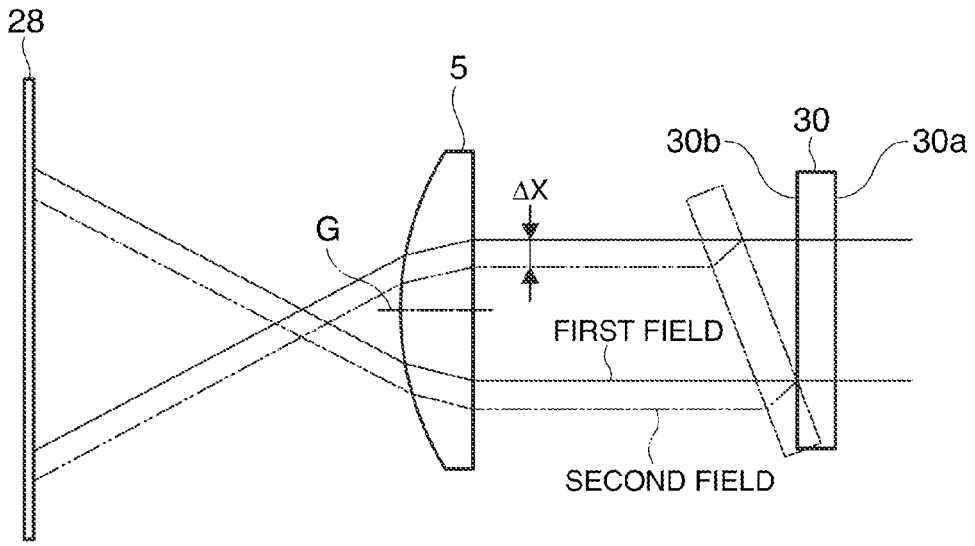
FIG. 2 shows a state of optical axis shift when a light transmissive plate is driven.
Figure 3:
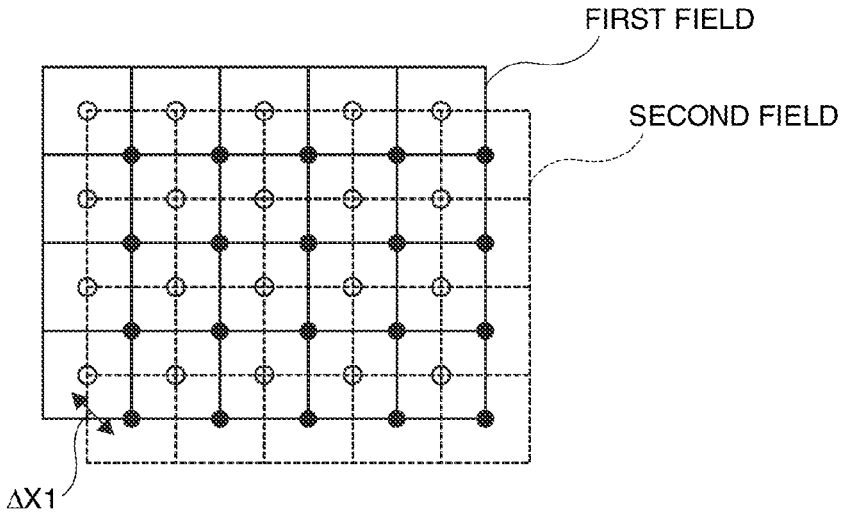
FIG. 3 is a conceptual diagram of shifted positions of pixel images.
Figure 4:
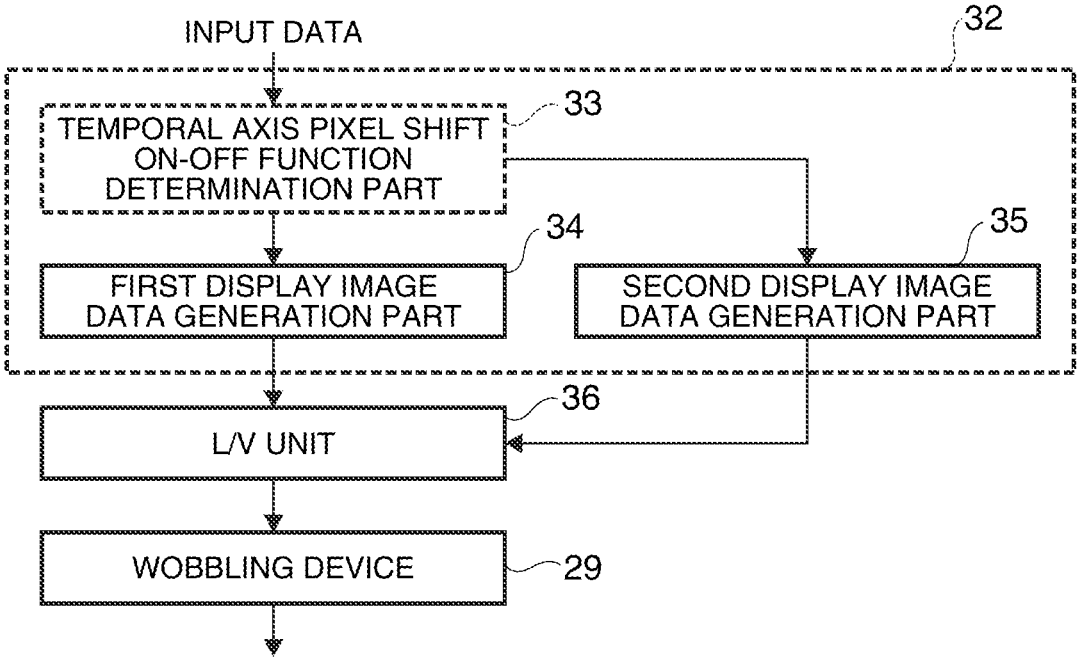
FIG. 4 is a block diagram showing a schematic configuration of a control unit of the projector of the embodiment.
Figure 5:
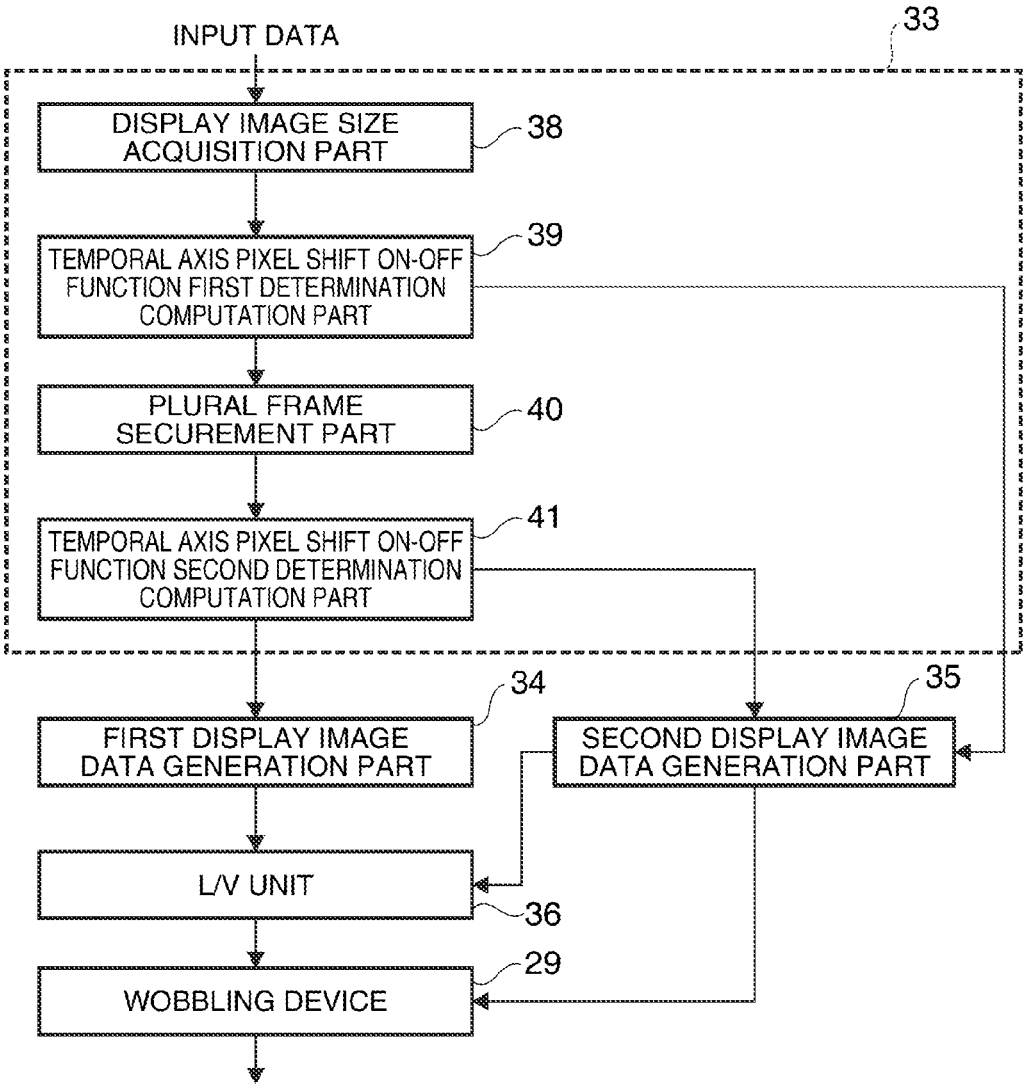
FIG. 5 is a block diagram showing a schematic configuration of a determination part within the control unit of the embodiment.
Figure 6:
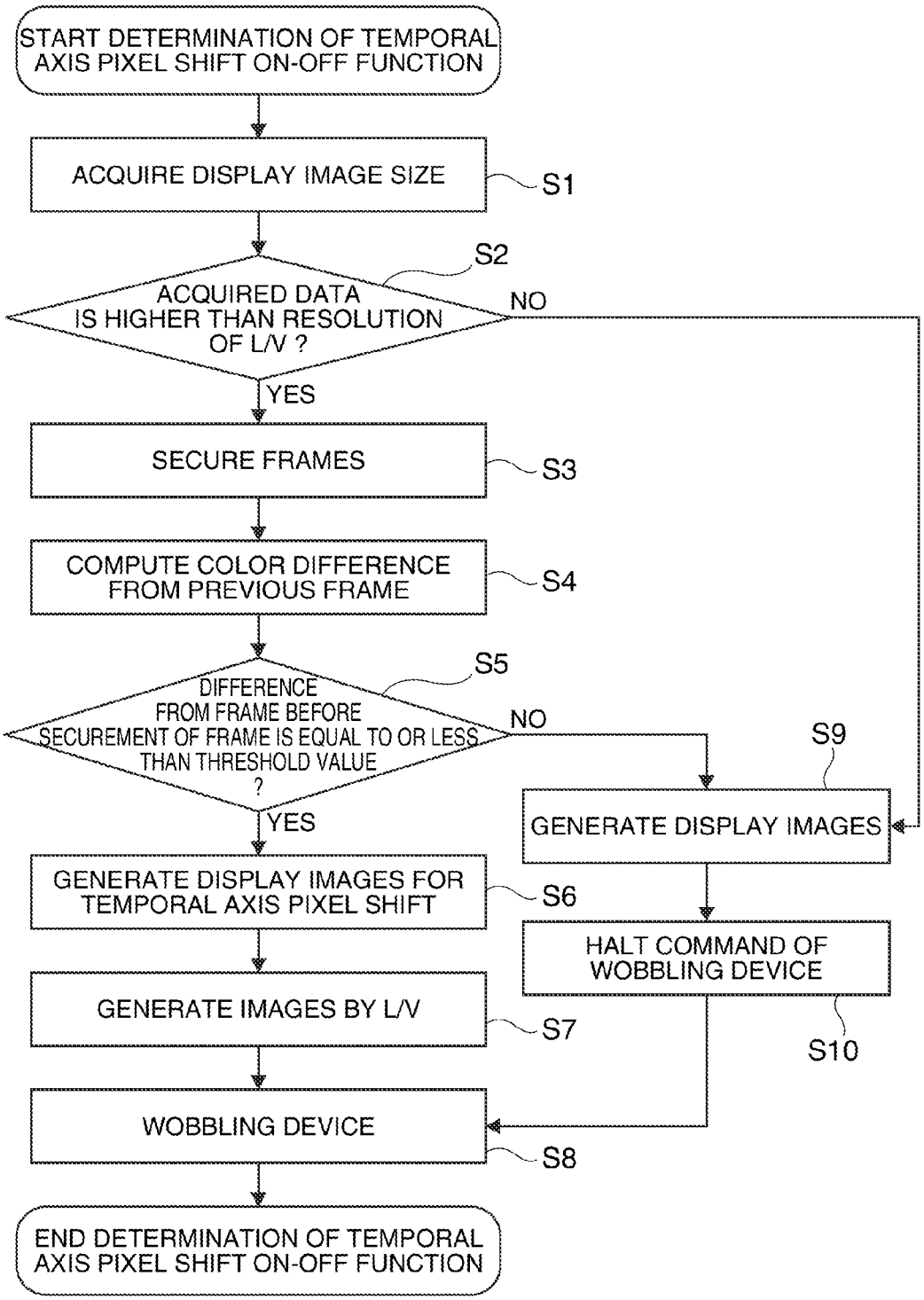
FIG. 6 is a flowchart showing a flow of processing of the control unit of the embodiment.

FIG. 1 is a schematic configuration diagram of the projector of the embodiment. FIG. 2 shows a state of optical axis shift when a light transmissive plate is driven. FIG. 3 is a conceptual diagram of shifted positions of pixel images. FIG. 4 is a block diagram showing a schematic configuration of a control unit. FIG. 5 is a block diagram showing a schematic configuration of a determination part within the control unit. FIG. 6 is a flowchart showing a flow of processing of the control unit.

Note that, in the respective following drawings, the ratios and scales of dimensions may be differed depending on component elements for facilitating visualization of the component elements.

The projector 1 (image display apparatus) of the embodiment includes an illumination system 2, liquid crystal light valves 3R, 3G, 3B (light modulation devices), a cross dichroic prism 4 (light combining system), a projection lens (projection system), etc. as shown in FIG. 1. The illumination system 2 of the embodiment includes a light source 7, a pair of fly-eye lens arrays 8 sequentially arranged at the downstream of the light source 7, a polarization conversion element 9, dichroic mirrors 10, 11, etc. The light source 7 includes a white lamp 12 such as a high-pressure mercury lamp or a metal halide lamp, and a reflector 13 that reflects light of the white lamp 12 and outputs it forward. Accordingly, from the white lamp 12, white light containing red light (R-light), green light (G-light), blue light (B-light), i.e., plural color lights of different colors is output.

The pair of fly-eye lens arrays 8 homogenize the distribution of light intensity of light output from the light source 7. Thereby, the illuminance distribution of light radiated on the liquid crystal light valves 3R, 3G, 3B as illuminated areas are homogenized.

The polarization conversion element 9 includes a polarization beam splitter array (PBS array) and a half wave plate array though its detailed structure is not shown. Of the lights entering the PBS array from the fly-eye lens arrays 8, a linearly-polarized light in a first polarization direction is transmitted through a polarization separation layer (PBS layer) within the PBS array and a linearly-polarized light in a second polarization direction is reflected by the PBS layer within the PBS array. The reflected polarized light is output with its polarization direction changed in the first polarization direction by the half wave plate array. As described above, the polarization conversion element 9 is formed so that the polarization directions of the light source lights may be aligned in one direction without loss of the amount of the light source lights.

The dichroic mirrors 10, 11 are formed by stacking dielectric multilayer films on glass surfaces, for example. Thereby, the color lights in a predetermined wavelength band are selectively reflected and the color lights in other wavelength bands are transmitted. Specifically, of the light source lights output from the light source 7, the red light LR is transmitted through the dichroic mirror 10, and the green light LG and the blue light LB are reflected by the dichroic mirror 10. Further, of the green light LG and the blue light LB reflected by the dichroic mirror 10, the blue light LB is transmitted through the dichroic mirror 11 and the green light LG is reflected by the dichroic mirror 11.

The red light LR transmitted through the dichroic mirror 10 is reflected by a reflection mirror 15 and enters the liquid crystal light valve 3R for red light through a parallelizing lens 16. The green light LG reflected by the dichroic mirror 11 enters the liquid crystal light valve 3G for green light through a parallelizing lens 16. The blue light LB transmitted through the dichroic mirror 11 enters the liquid crystal light valve 3B for blue light through a relay system 17. The relay system 17 includes a relay lens 18, a reflection mirror 19, a relay lens 20, a reflection mirror 21, a relay lens 22, etc. sequentially arranged from the dichroic mirror 11 side. The relay lens 22 also functions as a parallelizing lens. In the case of the blue light, the optical path from the light source 7 to the liquid crystal light valve 3B is longer than those of the other color lights, and the relay system 17 is provided to prevent light loss due to the longer optical path.

Each of the liquid crystal light valves 3R, 3G, 3B includes a transmissive liquid crystal cell 24 and polarizers 25, 26 respectively provided at the light incident side and the light exit side thereof. The transmissive liquid crystal cell 24 is of active matrix type, for example, and has a liquid crystal layer sandwiched between a pair of electrodes. Further, the liquid crystal light valves 3R, 3G, 3B are electrically connected to a signal source that supplies image signals. When image signals are supplied from the signal source, voltages are applied between the electrodes of the transmissive liquid crystal cells 24 and orientation directions of liquid crystal molecules are controlled in response to the applied voltages. Thereby, lights can be modulated. The red light LR, the green light LG, and the blue light LB modulated by the respective liquid crystal light valves 3R, 3G, 3B enter the cross dichroic prism 4.

The cross dichroic prism 4 has a structure formed by bonding triangular prisms to have a selective reflection surface by which the red light LR is reflected and the green light LG and the blue light LB are transmitted and a selective reflection surface by which the blue light LB is reflected and the red light LR and the green light LG are transmitted orthogonal to each other on the inner surfaces. The red light LR and the blue light LB are selectively reflected by these selective reflection surfaces, the green light LG is selectively transmitted through the selective reflection surfaces, and the three color lights are output to the same side. Thereby, the three color lights are superimposed to form a combined light L.

The combined light L output from the cross dichroic prism 4 is enlarged and projected onto a screen 28 (projection surface) by the projection lens 5 containing plural lens groups. Further, in the embodiment, a wobbling device 29 (pixel image shift unit) is provided between the cross dichroic prism 4 and the projection lens 5. The wobbling device 29 temporally shifts the positions of the images of the respective pixels of the liquid crystal light valves 3R, 3G, 3B projected on the screen 28. In the embodiment, as an example of the wobbling device 29, a light transmissive plate 30 is used.

The light transmissive plate 30 produces refraction inside when the light is transmitted and shifts the optical axis of the transmitted light, and includes a parallel plate formed from a material having light transmissivity such as glass, for example. Further, a drive unit 31 that drives the light transmissive plate 30 to change the tilt of the light transmissive plate 30 in a direction of an arrow A is provided. The drive unit 31 drives the light transmissive plate 30 so that the angle formed by the light-incident surface of the light transmissive plate 30 and a surface perpendicular to the optical axis of the projection lens 5 may temporally change. Specifically, the drive unit 31 is adapted to switch the angle formed by the light-incident surface of the light transmissive plate 30 and the surface perpendicular to the optical axis of the projection lens 5 between a first angle θ1 and a second angle θ2 at 120 Hz. For the drive unit 31, for example, a piezoelectric device may be used. Further, a control unit 32 that controls the respective liquid crystal light valves 3R, 3G, 3B and the drive unit 31 is provided.

An action when the tilt of the light transmissive plate 30 changes is shown in FIG. 2. Note that, in FIG. 2, for simplicity of the drawing, the projection lens 5 is shown as one lens. First, if a light-incident surface 30*a* of the light transmissive plate 30 is perpendicular to the optical axis G of the projection lens 5 as shown by solid lines, the light L output from the cross dichroic prism 4 perpendicularly enters the light-incident surface 30*a* of the light transmissive plate 30 and is perpendicularly output from a light-exiting surface 30*b*, and the light L is not refracted by the light transmissive plate 30 and the position of the optical axis of the transmitted light does not shift between the upstream and the downstream of the light transmissive plate 30. Then, when the light-incident surface 30*a* of the light transmissive plate 30 is tilted relative to the optical axis of the projection lens 5 as shown by chain double-dashed lines, the light output from the cross dichroic prism 4 enters the light-incident surface 30*a* of the light transmissive plate 30 at an angle other than a right angle, refraction is produced, and further, the light enters the light-exiting surface 30*b* at an angle other than a right angle, and is refracted and output. Accordingly, the position of the optical axis of the transmitted light shifts by a distance ΔX in response to the tilt angle between the upstream and the downstream of the light transmissive plate 30.

FIG. 3 shows a state in which images of pixels projected on the screen 28 shift. In the embodiment, the images includes images of one frame rewritten at 60 Hz (i.e., one frame =1/60 seconds), and the light transmissive plate 30 is switched between the above described first angle θ1 and second angle θ2 at 120 Hz. In this regard, as shown in FIG. 3, the lattice including plural pixel images located in solid lines at arbitrary 1/120 seconds (this is referred to as the first field) shifts to the position shown by broken lines at the next 1/120 seconds (this is referred to as the second field). The plural pixel images are arranged in the horizontal direction and the vertical direction of the screen 28, and it is desirable that the shift direction is oblique relative to the arrangement direction of the pixel images. Further, it is desirable that the shift distance ΔX1 is set to a half of the length of the diagonal line of one lattice. In this manner, the images located in the first field are rewritten at 60 Hz, and the images located in the position of the second field, which is shifted from the position of the first field, are also rewritten at 60 Hz. In this regard, the eyes of an observer fail to recognize the slight position change of the pixel images at 120 Hz, and thus, the observer may obtain feeling of improvement of the display resolution.

As below, a configuration of the control unit 32 will be explained.

As shown in FIG. 4, the control unit 32 has a temporal axis pixel shift on-off function determination part 33 (hereinafter, simply referred to as "determination part", an image determination part), a first display image data generation part 34, and a second display image data generation part 35. The determination part 33 determines whether images to be displayed are still images or moving images based on input image signals. Further, the determination part 33 outputs a control signal that allows one of the first display image data generation part 34 and the second display image data generation part 35, which will be described later, to generate image data (signals for modulation) based on a determination result of itself. The control unit 32 controls the drive unit 31 of the wobbling device 29 to constantly perform temporal axis pixel shift unless the images to be displayed are determined to be moving images.

Note that, in the block diagram of FIG. 4, for simplicity of the drawing, the part of the optical system from the light source 7 to the cross dichroic prism 4 in FIG. 1 is collectively shown as a light valve unit 36 (L/V unit).

The first display image data generation part 34 generates image data, i.e., signals for modulation when display is performed without the temporal axis pixel shift. Therefore, the first display image data generation part 34 generates signals for modulation to be supplied to the respective liquid crystal light valves 3R, 3G, 3B based on the input image signals like a display image data generation part that an existing projector without the pixel shift function has.

The second display image data generation part 35 generates image data, i.e., signals for modulation when display is performed with the temporal axis pixel shift. The second display image data generation part 35 has a timing generation circuit and an image processing circuit (not shown). The timing generation circuit generates timing signals indicating the start time of the first field and the start time of the second field, and output them to the drive unit 31 and the image processing circuit. The image processing circuit generates signals for first modulation for the first field and signals for second modulation for the second field based on the image signals. The image processing circuit supplies the signals for first modulation to the respective liquid crystal light valves 3R, 3G, 3B in synchronization with the display timing of the images of the first field determined by the timing signal and supplies the signals for second modulation to the respective liquid crystal light valves 3R, 3G, 3B in synchronization with the display timing of the images of the second field determined by the timing signal.

As shown in FIG. 5, the determination part 33 of the embodiment has a display image size acquisition part 38, a temporal axis pixel shift on-off function first determination computation part 39 (hereinafter, simply referred to as "first determination computation part"), a plural frame securement part 40, and a temporal axis pixel shift on-off function second determination computation part 41 (hereinafter, simply referred to as "second determination computation part"). The display image size acquisition part 38 acquires sizes of the images to be displayed based on the input image signals. The first determination computation part 39 computes a difference between the predetermined resolution of the liquid crystal light valves 3R, 3G, 3B and the resolution of the input image signals and compares them. The plural frame securement part 40 includes a frame memory etc., for example, and secures image signals of plural frames. The second determination computation part 41 computes a color difference between image signals of temporally adjacent two frames secured by the plural frame securement part 40.

Here, a flow of the processing of the control unit 32 will be explained with reference to FIG. 6.

First, the display image size acquisition part 38 acquires the sizes of the images to be displayed based on the input image signals, and outputs the acquisition result of the image size to the first determination computation part 39 (step S1 in FIG. 6).

Then, the first determination computation part 39 computes a difference between the image size input from the display image size acquisition part 38, i.e., the resolution of the images and the resolution of the liquid crystal light valves 3R, 3G, 3B stored in advance and compares them (step S2 in FIG. 6).

As a result of comparison between the resolution of the images and the resolution of the liquid crystal light valves, if the resolution of the images is equal to or less than the resolution of the liquid crystal light valves 3R, 3G, 3B, the temporal axis pixel shift function is determined to be stopped, and the first display image data generation part 34 generates signals for modulation when display is performed without the temporal axis pixel shift (step S9 in FIG. 6).

Further, the first display image data generation part 34 generates a halt command signal for halting the operation of the wobbling device 29, and outputs the halt command signal to the drive unit 31 of the wobbling device 29 (step S10 in FIG. 6).

On the other hand, as a result of comparison between the resolution of the images and the resolution of the liquid crystal light valves, if the resolution of the images is more than the resolution of the liquid crystal light valves 3R, 3G, 3B, the plural frame securement part 40 secures image signals of plural frames (step S3 in FIG. 6).

Then, the second determination computation part 41 computes the color difference between the image signals of temporally adjacent two frames obtained by the plural frame securement part 40 (step S4 in FIG. 6).

Further, in the second determination computation part 41, a threshold value of the color difference for determination as to whether the images are still images or moving images is set in advance, and the second determination computation part 41 compares the computed value to the threshold value of the color difference (step S5 in FIG. 6).

As a result of the comparison between the computed value and the threshold value of the color difference, if the computed value is equal to or less than the threshold value, the second determination computation part 41 determines continuation of the temporal axis pixel shift on the grounds that the display images are still images, and the second display image data generation part 35 respectively generates the signals for first modulation for the first field and the signals for second modulation for the second field when display is performed with the temporal axis pixel shift (step S6 in FIG. 6).

Then, the respective liquid crystal light valves 3R, 3G, 3B perform modulation of incident lights based on the signals for first modulation and the signals for second modulation input from the second display image data generation part 35 and form images (step S7 in FIG. 6).

Further, in the wobbling device 29 at the downstream of the liquid crystal light valves 3R, 3G, 3B, the transmitted light axis is shifted by the driving of the light transmissive plate 30, and the temporal axis pixel shift is performed while the positions of the pixel images on the screen 28 shift (step S8 in FIG. 6).

On the other hand, as a result of the comparison between the computed value and the threshold value of the color difference, if the computed value is more than the threshold value, the second determination computation part 41 determines stop of the temporal axis pixel shift on the grounds that the display images are moving images, and the first display image data generation part 34 generates signals for modulation when display is performed without the temporal axis pixel shift (step S9 in FIG. 6).

Further, the first display image data generation part 34 generates a halt command signal for halting the operation of the wobbling device 29, and outputs the halt command signal to the drive unit 31 of the wobbling device 29 (step S10 in FIG. 6).

According to the projector 1 of the embodiment, the control unit 32 is basically set to constantly execute the temporal axis pixel shift, continues the temporal axis pixel shift if the images to be displayed are determined to be still images, and thereby, the display resolution of the still images may be improved. On the other hand, the control unit 32 controls the drive unit 31 of the wobbling device 29 to stop the temporal axis pixel shift if the images to be displayed are determined to be moving images, and thereby, image deterioration of blur or the like of the moving image may be suppressed and the smooth moving image may be represented. Further, the smooth moving image may be represented without insertion of frames of black representation, and thus, the display does not become darker. Using the projector 1 of the embodiment, both the improvement of display resolution in the still images and the smoothness and brightness of display in the moving images may be realized.

Further, because of the configuration in which the control unit 32 compares the image signals in the plural frames, determines whether the images to be displayed are still images or moving images, and controls the drive unit 31 of the wobbling device 29, whether the use or nonuse of the temporal axis pixel shift function using normal image data may be determined. Thereby, it is not necessary to prepare special image data. Further, since the determination as to whether the images are still images or moving images is made with reference to the threshold value, the switching level between the use and nonuse of the temporal axis pixel shift function may be adjusted by appropriately changing the threshold value. For example, in the case where the threshold value is set higher, for some moving images, the temporal axis pixel shift is executed for improvement of the display resolution. Contrary, in the case where the threshold value is set lower, even for the still images that slightly move, the temporal axis pixel shift may be stopped and the smooth motion may be represented.

Second Embodiment

As below, the second embodiment of the embodiment will be explained using FIGS. 7 and 8.

An image display apparatus according to the invention is also a configuration example of the 3LCD projector and its basic configuration is the same as that of the first embodiment, and the explanation of the basic configuration of the projector will be omitted and only the configuration of the control unit will be explained.

Figure 7:
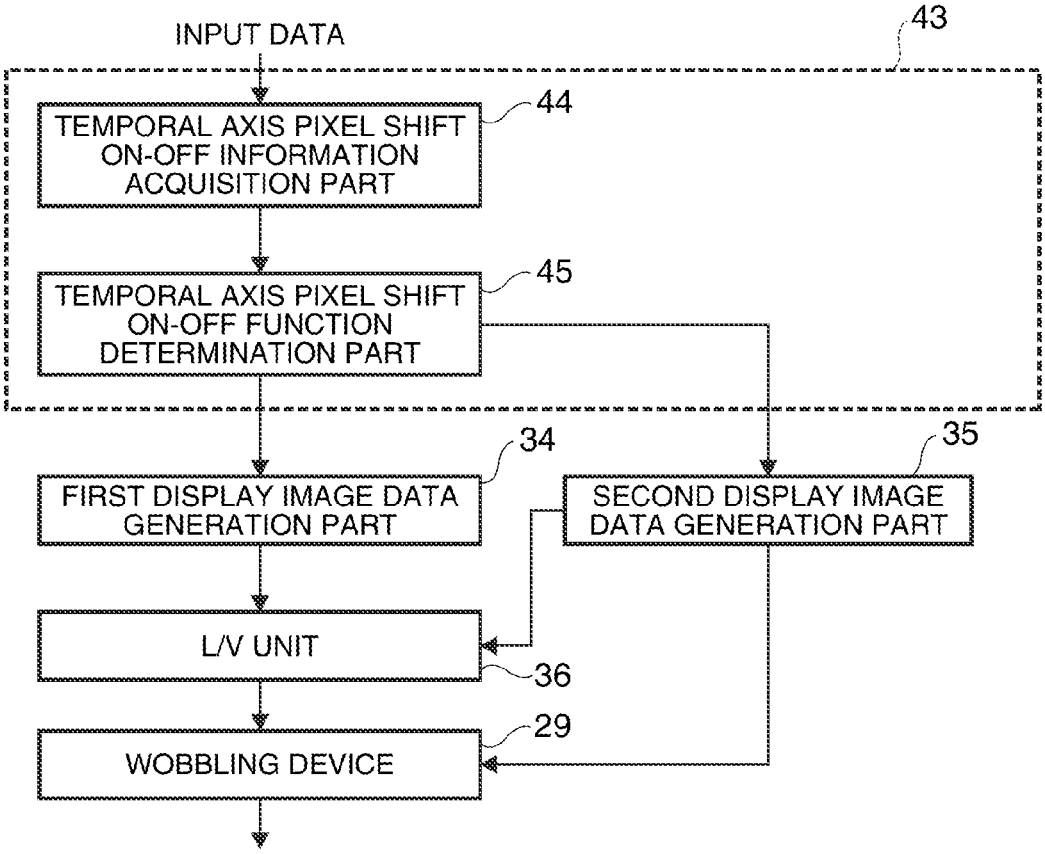
FIG. 7 is a block diagram showing a schematic configuration of a determination part within a control unit of a projector of a second embodiment of the invention.

FIG. 7 is a block diagram showing a configuration of a determination part within a control unit of the projector of the embodiment. FIG. 8 is a flowchart showing a flow of processing of the control unit.

The first embodiment has the configuration in which the control unit automatically determines the use or nonuse of the temporal axis pixel shift based on the difference computation of the image signals of the temporally adjacent two frames. On the other hand, the embodiment employs a configuration in which information for determination of use or nonuse of the temporal axis pixel shift is added in advance to the image signals to be input and the control unit reads the information and determines the use or nonuse of the temporal axis pixel shift.

As shown in FIG. 7, the determination part 43 of the embodiment has a temporal axis pixel shift on-off information acquisition part 44 (hereinafter, simply referred to as "information acquisition part") and a temporal axis pixel shift on-off function determination part 45 (hereinafter, simply referred to as "function determination part"). The information acquisition part 44 acquires still image/moving image information previously contained in the input image signals. The still image/moving image information refers to information indicating whether the image signals themselves are still images or moving images, that is, whether the temporal axis pixel shift is executed or stopped. The determination part 43 generates a stop command signal for stopping the temporal axis pixel shift if the images are moving images based on the still image/moving image information obtained by the information acquisition part 44.

Next, a flow of the processing of the control unit will be explained with reference to FIG. 8.

Figure 8:
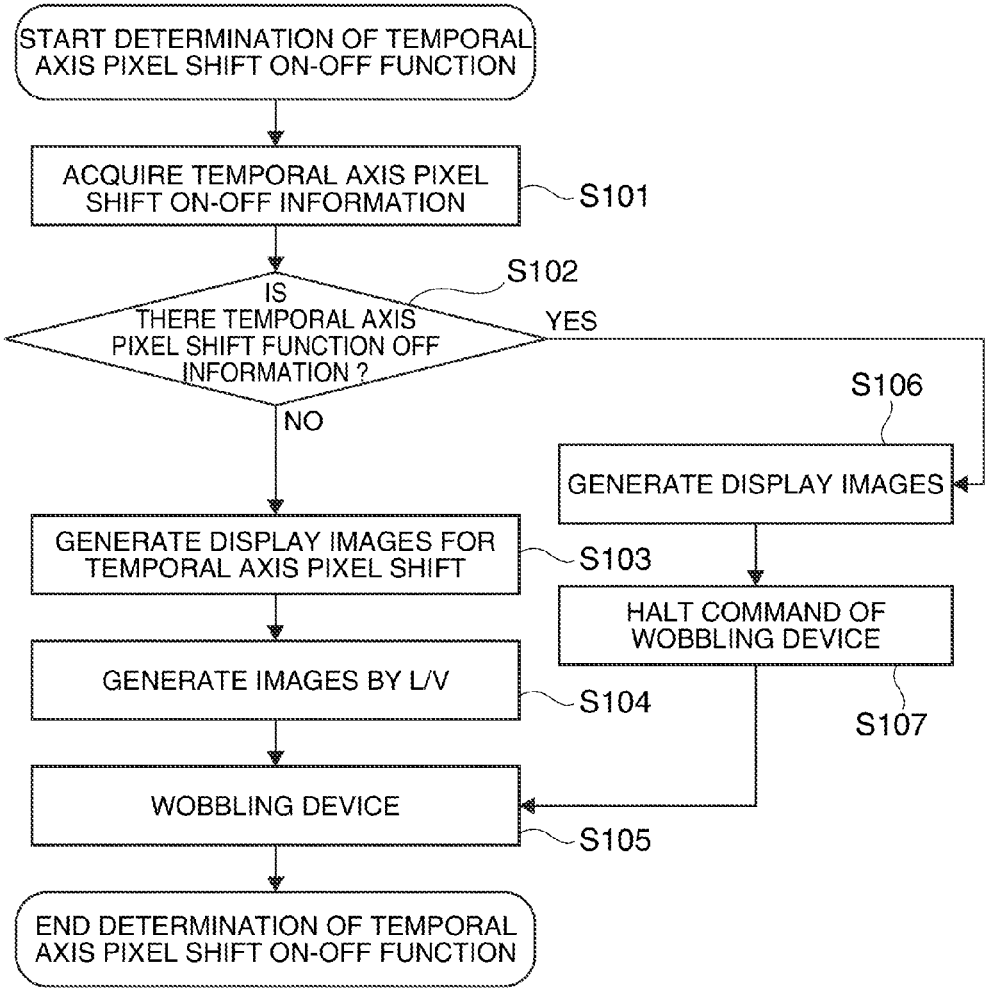
FIG. 8 is a flowchart showing a flow of processing of the control unit of the embodiment.

First, the information acquisition part 44 acquires still image/moving image information from the input image signals (step S101 in FIG. 8).

Then, the function determination part 45 reads the still image/moving image information input from the information acquisition part 44 and determines whether the images are moving images or not, that is, whether information for stopping the temporal axis pixel shift is contained or not (step S102 in FIG. 8).

Here, if the images are still images, that is, the information for stopping the temporal axis pixel shift is not contained, the function determination part 45 determines continuation of the temporal axis pixel shift on the grounds that the display images are still images, and the second display image data generation part 35 respectively generates the signals for first modulation for the first field and the signals for second modulation for the second field when display is performed with the temporal axis pixel shift (step S103 in FIG. 8).

Then, the respective liquid crystal light valves 3R, 3G, 3B perform modulation of incident lights based on the signals for first modulation and the signals for second modulation input from the second display image data generation part 35 and form images (step S104 in FIG. 8).

Further, in the wobbling device 29 at the downstream of the liquid crystal light valves 3R, 3G, 3B, the transmitted light axis is shifted by the driving of the light transmissive plate 30, and the temporal axis pixel shift is performed while the positions of the pixel images on the screen 28 shift (step S105 in FIG. 8).

On the other hand, if the images are moving images, that is, the information for stopping the temporal axis pixel shift is contained, the function determination part 45 determines stop of the temporal axis pixel shift on the grounds that the display images are moving images, and the first display image data generation part 34 generates signals for modulation when display is performed without the temporal axis pixel shift (step S106 in FIG. 8).

Further, the first display image data generation part 34 generates a halt command signal for halting the operation of the wobbling device 29, and outputs the halt command signal to the drive unit 31 of the wobbling device 29 (step S107 in FIG. 8).

Also, in the projector of the embodiment, the same advantage that both the improvement of display resolution in the still images and the smoothness and brightness of display in the moving images may be realized as that of the first embodiment may be obtained. Further, in the case of the embodiment, it is necessary to prepare image signals previously containing the still image/moving image information, however, means for comparing image data of plural frames and determining whether the images are still images or moving images (for example, the plural frame securement part, the second determination computation part, etc. of the first embodiment) are not necessary, and the load on the apparatus may be reduced and the configuration of the control unit may be simplified. The embodiment is preferable for the case of application of display of digital signage and presentation materials for which image contents to be displayed are determined in advance.

Note that the technological range of the invention is not limited to the above described embodiments, and various changes may be made without departing from the scope of the invention. For example, two configurations of the configuration in which the control unit automatically determines use or nonuse of the temporal axis pixel shift in the first embodiment and the configuration in which information for determination of use or nonuse of the temporal axis pixel shift is added in advance to the image signals to be input and the control unit reads the information have been exemplified. In addition to these configurations, a configuration in which a user of the projector appropriately determines use or nonuse of the temporal axis pixel shift in response to image contents and manually operates a switch or the like provided in the projector to switch between them, for example.

Further, the example in which the pixel images are shifted to two positions of the first field and the second field has been exemplified, however, a configuration in which the pixel images are shifted to three or more positions may be employed. Further, the example in which the transmissive liquid crystal light valves are used as the light modulation devices has been exemplified, however, reflective liquid crystal light valves, Digital Micromirror Devices (DMD, registered trade mark), or the like may be used. In the case of using DMD, use or nonuse of the temporal axis pixel shift may be switched not for the entire screen, but for the partial screen, and, for example, the case where moving images are partially incorporated into still images or the like may be accommodated. Further, the specific configurations of the respective parts of the projectors described in the embodiments may appropriately be changed.

What is claimed is:

1. An image display apparatus comprising:

a light source that outputs light;

a light modulation device that has plural pixels arranged in a matrix and modulates the light from the light source;

a projection system that projects the light modulated by the light modulation device onto a projection surface;

a pixel image shift unit that can shift positions of images of the pixels of the light modulation device projected on the projection surface, and a control unit that controls the light modulation device and the pixel image shift unit, wherein the control unit can switch whether the pixel image shift unit temporally shifts the positions of the images of the pixels or not, wherein the control unit controls the pixel image shift unit to not temporally shift the positions of the images of the pixels on the projection surface if the resolution of the images to be displayed is equal to or lower than the resolution of the light modulation device and the control unit determines whether the images to be displayed are still images or moving images if resolution of images to be displayed is higher than resolution of the light modulation device, wherein, following determining whether the images to be displayed are still images or moving images based upon the resolution of the images, the control unit controls the pixel image shift unit to temporally shift the positions of the images of the pixels on the projection surface if the images are determined to be still images and not to temporally shift the positions of the images of the pixels on the projection surface if the images to be displayed are determined to be moving images.

2. The image display apparatus according to claim 1, wherein the control unit controls the pixel image shift unit to temporally shift the positions of the images of the pixels on the projection surface constantly unless images to be displayed are determined to be moving images.

3. The image display apparatus according to claim 1, wherein the control unit includes an image determination part that compares respective image data input in plural frames and determines whether images to be displayed are still images or moving images, and the image determination part outputs a control signal to the pixel image shift unit based on a determination result of itself.

4. The image display apparatus according to claim 1, wherein the control unit includes an image determination part that acquires still image/moving image information previously contained in input image data, and determines whether images to be displayed are still images or moving images from the still image/moving image information, and the image determination part outputs a control signal to the pixel image shift unit based on a determination result of itself.

5. The image display apparatus according to claim 1, wherein the transmissive plate is configured to be tilted from a first position to a second position, wherein a light incident surface of the transmissive plate is perpendicular to the optical axis of the modulated light in the first position and wherein the light incident surface of the transmissive plate is changed to an angle other than perpendicular at the second position.

6. The image display apparatus according to claim 1, wherein the pixel image shift unit is disposed between the light combining system and the projection system.

7. The image display apparatus according to claim 6, wherein the light source is separated into components.

8. The image display apparatus according to claim 7, further comprising a light modulation device for each of the components, wherein each light modulation device has plural pixels arranged in a matrix and modulates one of the components of the light from the single light source.

9. The image display apparatus according to claim 8, further comprising a light combining system that combines the modulated light components.

10. An image display method using an image display apparatus including a single light source that outputs light, a light modulation device that has plural pixels arranged in a matrix and modulates the light from the light source, a projection system that projects the light modulated by the light modulation device onto a projection surface, and a pixel image shift unit that shifts positions of images of the pixels of the light modulation device projected on the projection surface, the method comprising:

controlling the light modulation device and the pixel image shift unit to switch whether the pixel image shift unit temporally shifts the positions of the images of the pixels or not, further comprising:

controlling the pixel image shift unit not to temporally shift the positions of the images of the pixels on the projection surface if the resolution of the images to be displayed is equal to or lower than the resolution of the light modulation device and the control unit determines whether the images to be displayed are still images or moving images if resolution of images to be displayed is higher than resolution of the light modulation device, and following determining whether the images to be displayed are still images or moving based upon the resolution of the images, controlling the pixel image shift unit to temporally shift the positions of the images of the pixels on the projection surface if the images are determined to be still images and not to temporally shift the positions of the images of the pixels on the projection surface if the images to be displayed are determined to be moving images.

* * * * *